US006466850B1

(12) United States Patent
Hilgart

(10) Patent No.: US 6,466,850 B1
(45) Date of Patent: Oct. 15, 2002

(54) DEVICE FOR REACTING TO DIPPER STALL CONDITIONS

(75) Inventor: Randall D. Hilgart, Milwaukee, WI (US)

(73) Assignee: Harnischfeger Industries, Inc., Wilmington, DE (US)

( * ) Notice: Subject to any disclaimer, the term of this patent is extended or adjusted under 35 U.S.C. 154(b) by 6 days.

(21) Appl. No.: 09/634,781

(22) Filed: Aug. 9, 2000

(51) Int. Cl.[7] ..... G06F 19/00

(52) U.S. Cl. ..... 701/50; 37/348; 414/690

(58) Field of Search ..... 414/690, 718, 414/728; 37/395, 396, 397, 398, 399, 348; 701/50

(56) References Cited

U.S. PATENT DOCUMENTS 5,408,767 A * 4/1995 Hazama et al. ..... 414/718 X
5,469,647 A * 11/1995 Profio ..... 414/718 X

* cited by examiner

*Primary Examiner*—Donald W. Underwood
(74) *Attorney, Agent, or Firm*—James Earl Lowe, Jr.

(57) ABSTRACT

A shovel including a dipper for gathering material from a bank. The shovel further includes a hoist motor operating control for operating a hoist motor, a speed sensor for monitoring the hoist motor speed, a torque sensor for monitoring the hoist motor torque, and a mechanism communicating with a crowd motor control, the torque sensor and the speed sensor for moving a dipper handle toward a boom when the hoist motor speed is below a low-speed value while under high torque, and for permitting movement of the dipper away from the boom when the hoist motor speed is above the low-speed value or not under high torque. More particularly, the dipper handle moving mechanism further includes a mechanism for varying the selected speed of movement of the dipper toward the boom, and the shovel further includes a mechanism for determining the amount of time the hoist motor speed is below a predetermined low-speed value while under high torque, and a mechanism for adjusting the selected speed of movement of the dipper toward the boom upward if the time the hoist motor speed is below a predetermined low-speed value while under high torque is too large, and for adjusting the selected speed of movement of the dipper toward the boom downward if the time the hoist motor speed is below a predetermined low-speed value while under high torque is too small.

6 Claims, 3 Drawing Sheets

DEVICE FOR REACTING TO DIPPER STALL CONDITIONS

BACKGROUND OF THE INVENTION

The invention is directed to a power shovel including a dipper for gathering material from a bank and then moving the material to either a material pile or a truck for removing the material from the work site. More particularly, this invention is directed to a mechanism for reducing the likelihood of the dipper entering into what is known as a dipper stall condition. Still more particularly, this invention is directed to a mechanism for automating the behavior of the power shovel at dipper stall conditions.

A dipper stall occurs when the dipper enters a bank of material, and is then prevented from continuing any further, even though the hoist motor while operating at full power is attempting to raise the dipper. When this occurs, the motor power is highly reactive, and extra capacitors must be provided to absorb this reactive power. Dipper stall occurs when the resistance of the bank is greater than the force exerted by the hoist rope attached to the bail on the dipper. This excessive bank resistance occurs when the there is either too much material above the dipper, or when there is too much frictional force on the dipper.

In the prior art, an operator would visually observe the dipper movement through the bank of material. The movement of the dipper through the material was accomplished by operating the hoist motor at full speed to raise the dipper through the bank of the material, while at the same time moving the dipper handle forward at full speed to ensure the dipper enters into the bank of material. If the operator believed a dipper stall condition was about to be reached or had been reached, the operator would operate the crowd motor control to slow down or reverse direction of movement of the dipper handle. Once the dipper left the stall condition, the operator would again begin to move the dipper handle forward in order to move the dipper through the bank of material.

Some prior art power shovels monitored the hoist motor current and issued an alarm when the hoist motor current was reaching an upper limit, thus indicating to the operator that a stall condition has occurred.

SUMMARY OF THE INVENTION

This invention is a shovel including a dipper for gathering material from a bank, a platform, an upwardly extending boom connected at a lower end to the platform, and a sheave rotatably amounted on the upper end of the boom. The shovel further includes a winch drum mounted on the platform, a hoist motor for rotating the winch drum, and a hoist rope extending from the winch drum over the sheave and attached to the dipper. The shovel further includes a saddle block pivotally mounted on the boom, and a dipper handle slidably supported by the saddle block, and pivotable relative to the boom by the saddle block. The shovel further includes dipper handle moving means for moving the dipper and dipper handle away from and towards the boom, the moving means including a crowd motor and crowd motor operating means for operating the crowd motor, hoist motor operating means for operating the hoist motor, speed means for monitoring the hoist motor speed, and torque means for monitoring the hoist motor torque. The shovel further includes means communicating with the crowd motor operating means, the torque means and the speed means for moving the dipper handle toward the boom when the hoist motor speed is below a low-speed value while under high torque, and for permitting movement of the dipper away from the boom when the hoist motor speed is above the low-speed value or not under high torque.

In one embodiment, the dipper handle moving means further including means for varying the selected speed of movement of the dipper toward the boom, and the shovel further includes means for determining the amount of time the hoist motor speed is below a predetermined low-speed value while under high torque, and means for adjusting the selected speed of movement of the dipper toward the boom upward if the time the hoist motor speed is below a predetermined low-speed value while under high torque is too large, and for adjusting the selected speed of movement of the dipper toward the boom downward if the time the hoist motor speed is below a predetermined low-speed value while under high torque is too small.

In one embodiment, the shovel further includes means for determining the rate of change of the actual hoist motor speed while under high torque, and means for adjusting the low speed value upward if the rate of change of the actual hoist motor speed while under high torque is too fast, and for adjusting the low speed value downward if the rate of change of the actual hoist motor speed while under high torque is too slow.

In one embodiment, the speed means is a voltage sensor and the torque means is a current sensor.

One of the principle objects of this invention is to improve operator performance by improving the dipper fill factor. This is accomplished by ensuring the dipper is pulled out of the bank no further than necessary in order to prevent dipper stall.

Another of the principle objects of this invention is to increase the motor life of the hoist motor and to lessening the need for additional reactive power capacitance by reducing the amount of time the hoist motor operates at full load without actually hoisting the dipper.

Another of the principle objects of this invention is to lessen operator fatigue. In the prior art, the operator had to reverse the crowd motor every time a dipper stall occurred in order to pull the dipper out of the bank far enough so that there no longer is too much material above the dipper. After pulling the dipper out of the bank, the operator must then move the dipper handle forward again in order to once again cause the dipper to gather material. This invention permits the operator to keep the crowd motor control in it's forward direction, thus eliminating the need to frequently reverse the crowd motor direction.

Another of the principle objects of this invention is to permit less experienced operators to successfully operate the shovel by no longer requiring the operator to know how to react to dipper stall conditions. It also permits operation of the shovel during the night. Without this invention, operators are not able to observe that the dipper has entered into a stalled state or to observe how far the dipper has been removed from the bank of materials. This invention also reduces operator training time, and improves the dipper fill factor by not permitting an operator to pull back too far on the dipper thereby reducing the amount of material which enters the dipper.

Figure 1:
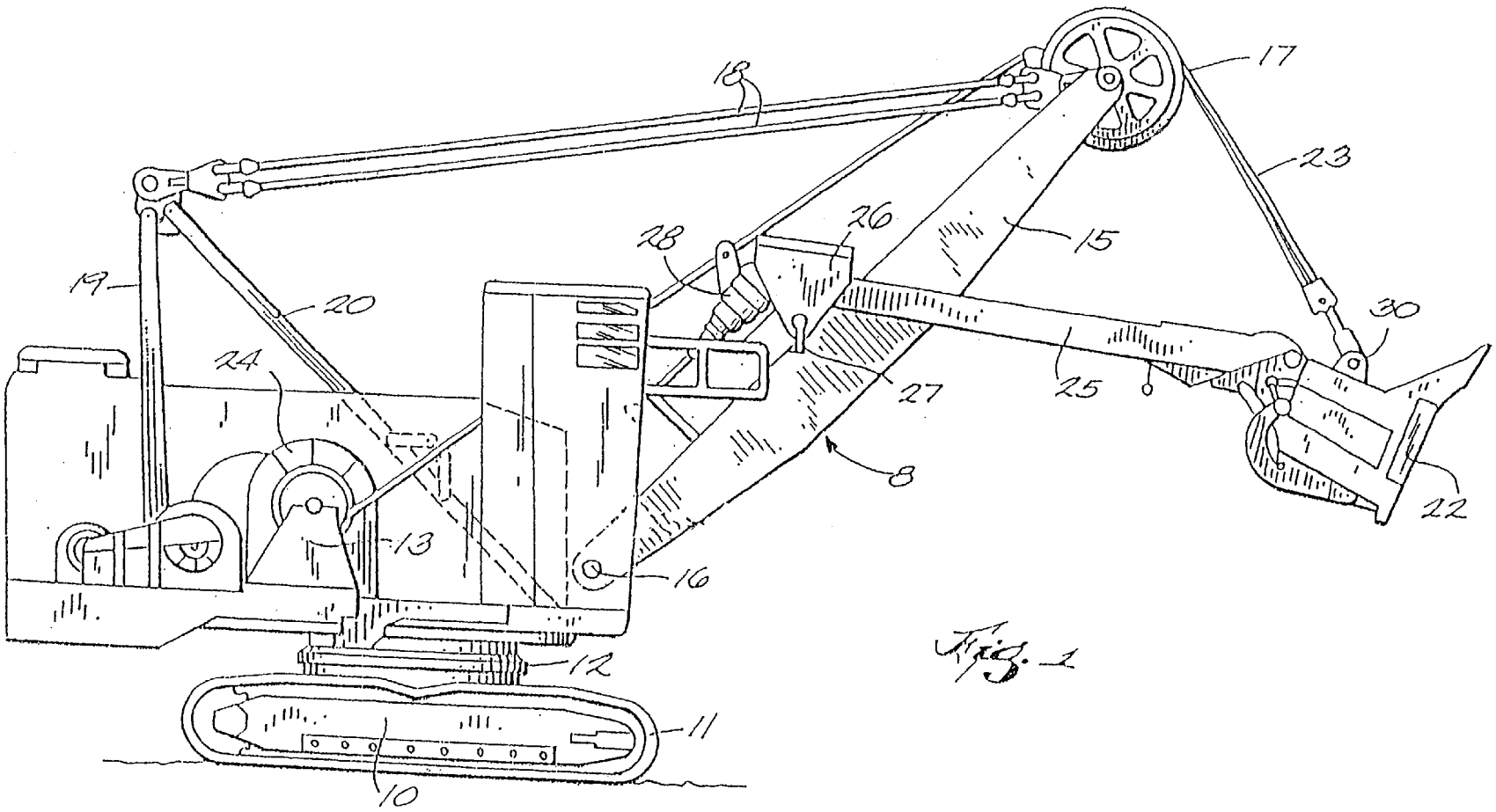
FIG. 1 is a plan view of a surface mining shovel.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof, as well as additional items. Use of "consisting of" and variations thereof as used herein is meant to encompass only the items listed thereafter and equivalents thereof.

DETAILED DESCRIPTION OF A PREFERRED EMBODIMENT

The invention is directed to a power shovel 8 including a dipper 22 for gathering material from a bank (not shown) and then moving the material to either a material pile (not shown) or a truck (not shown) for removing the material from the work site.

The power shovel 8 includes a platform in the form of a machinery deck 13, and an upwardly extending boom 15 connected at the lower end 16 to the platform 13, and a sheave 17 at the top of the boom 15. The dipper 22 is suspended from the boom 15 by a hoist rope 23 trained over the sheave 17 and attached to the dipper 22 at a bail pin 30. The machine structure is movable to locate the dipper 22 in respective loaded and unloading positions. More particularly, the structure is mounted on a turntable 12.

Referring to FIG. 1 the power shovel 8 depicted therein of the well known construction commonly referred to as a rope shovel. This shovel loader comprises a mobile base 10 supported on drive tracks 11, and having supported thereon through the turntable 12, the machinery deck 13. The turntable 12 permits full 360° rotation of the machinery deck 13 relative to the base.

The boom 15 is pivotally connected at 16 to the machinery deck 13. The boom 15 is held in a upwardly and outwardly extending relation to the deck 13 by a brace in the form of tension cables 18 which are anchored to a back stay 19 of a stay structure 20 rigidly mounted on the machinery deck 13.

The dipper 22 is suspended by the hoist rope or cable 23 from the sheave 17, the hoist rope 23 being anchored to a winch drum 24 mounted on the machinery deck 13. As the winch drum 24 rotates, the hoist rope 23 is either paid out or pulled in, lowering or raising the dipper 22. The dipper 22 has a handle 25 rigidly attached thereto, with the dipper handle 25 slidably supported in a saddle block 26, which is pivotally mounted on the boom 15 at 27. The dipper handle 25 has a rack tooth formation thereon (not shown) which engages a drive pinion (not shown) mounted in the saddle block 26. The drive pinion is driven by an electric motor and transmission unit 28 to effect extension or retraction of the dipper handle 25 relative to the saddle block 26.

A source of electrical power (not shown) is mounted on the machinery deck 13 to provide power to one or more hoist electric motors (not shown) which drives the winch drum 24, a crowd electric motor (not shown) which drives the saddle block transmission unit 28, and a swing electric motor (not shown) which turns the machinery deck turntable 12. The above described basic construction of the shovel loader is widely known and used and further details of the construction are not provided as they are well known in the art.

Each of the crowd, hoist, and swing motors is driven by its own motor controller (not shown) which responds to operator commands to generate the required voltages and currents in well known fashion. Interposed between the operator commands and the motor controllers is a programmable logic controller (PLC). The PLC includes a program which, in response to different conditions, causes the motor controllers to behave in a predetermined manner, as described below.

Figure 2:
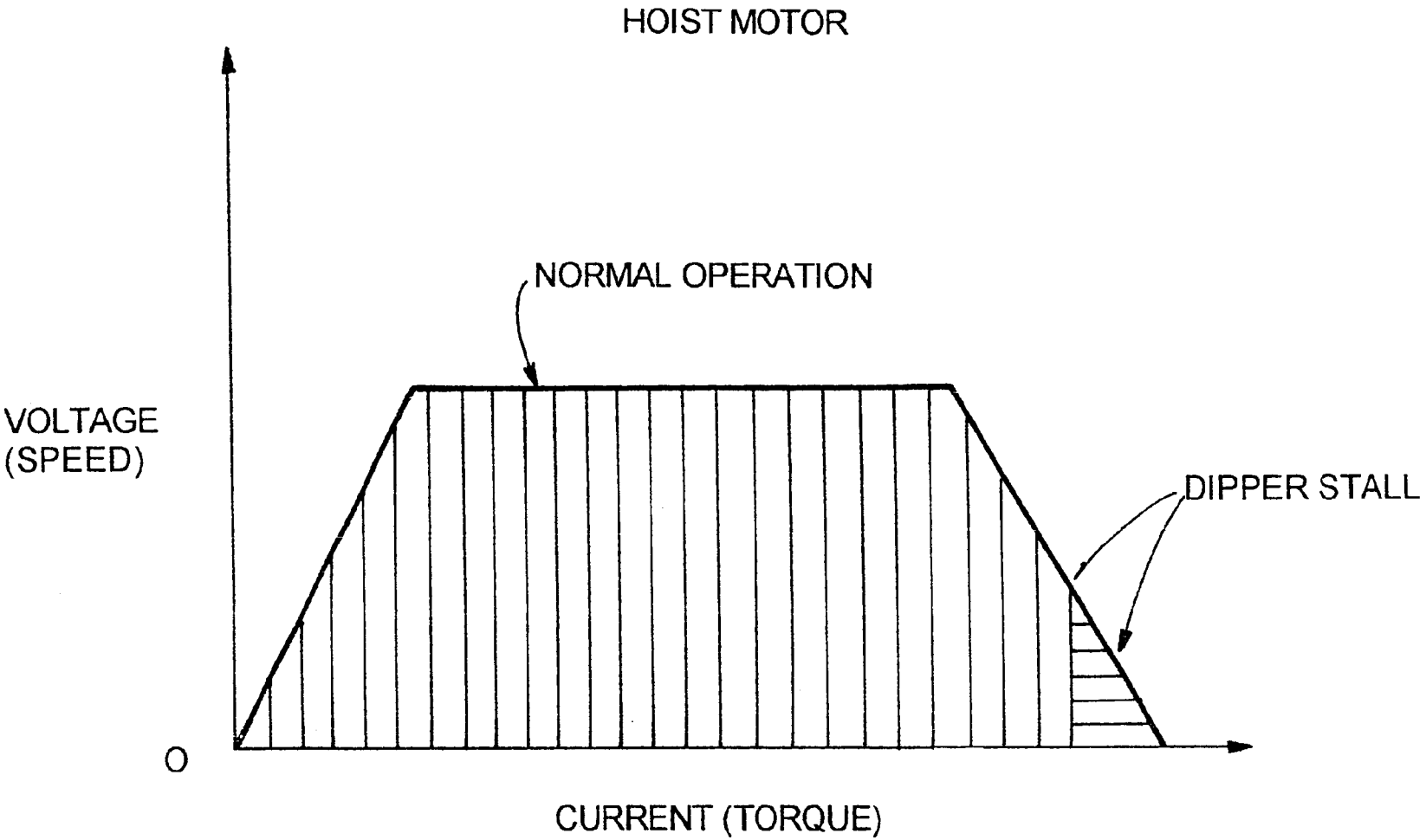
FIG. 2 is a graph of the hoist motor voltage and current.

FIG. 2 shows a graph of two parameters of the hoist motor. The vertical axis is voltage, which corresponds to the speed of the motor, and the horizontal axis is motor current, which corresponds to the torque being exerted by the hoist motor. A dipper stall condition occurs when the hoist motor speed has significantly decreased and the hoist motor torque has reached its upper limits. By monitoring these two hoist motor parameters, this invention can substantially reduce the occurrence of the dipper entering into a stall condition. This invention totally eliminates the need for the operator to slow down or reverse the direction of dipper handle 25 movement by use of the operator controls.

In the preferred embodiment of the invention, a hoist motor low-speed value is. selected. When that low speed value is reached, the PLC takes over and automatically begins to retract the dipper handle 25 at a selected speed. In response to the retraction of the dipper handle 25, the dipper 22 ultimately is pulled sufficiently far out of the bank of material to then permit the dipper 22 to once again be raised by the hoist motor. When the PLC senses that the speed of the hoist motor has once again increased above the lower speed value, the direction of movement of the dipper handle 25 is reversed by the operator still keeping the crowd motor control in a forward position, so the dipper handle 25 and the dipper 22 once again moves toward the bank of material.

Figure 3:
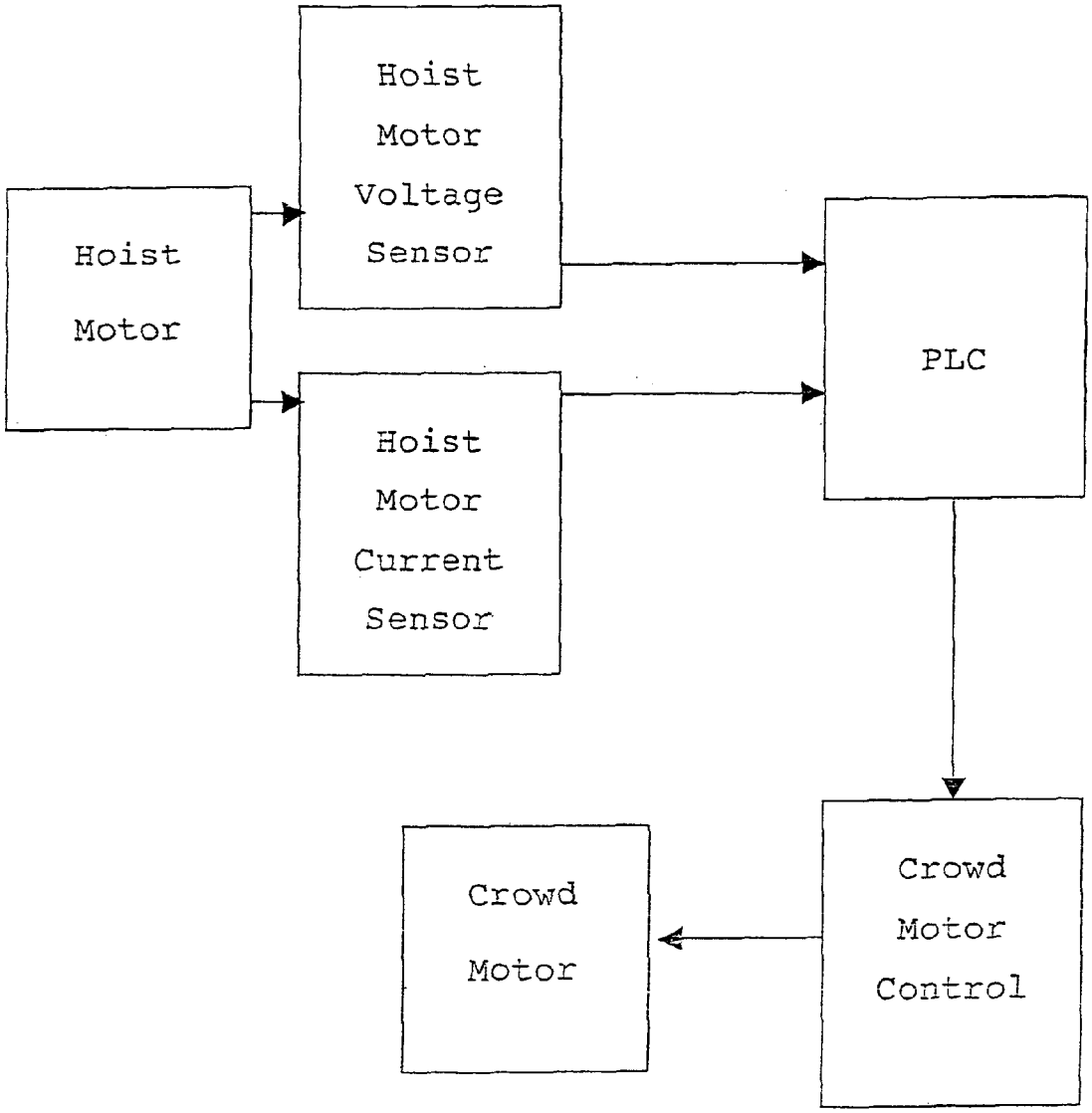
FIG. 3 is a function block diagram of part of the device for reacting to dipper stall conditions of the present invention.

More particularly, the power shovel 8 of this invention further includes, as shown schematically in FIG. 3, a speed sensor for monitoring the hoist motor speed, a torque sensor for monitoring the hoist motor torque, and the PLC communicating with the crowd motor control, the torque sensor and the speed sensor. The PLC includes a program which causes movement of the dipper handle 25 toward the boom 15 when the hoist motor speed is below a low-speed value while under high torque, and for permitting movement of the dipper handle 25 away from the boom 15 when the hoist motor speed is above the low-speed value or not under high torque.

In a preferred embodiment of the invention, the PLC is able to react to the power shovel 8 operating in different types of banks of material. The PLC tracks the hoist motor speed over time. When the dipper 22 enters into a stall condition, the speed of the hoist motor reaches a selected low speed value and then remains below this low speed value for some period of time until the speed once again picks up. The time during which the hoist motor stays below this low speed value is the amount of time the dipper 22 is in the stall condition.

In the preferred embodiment of the invention, a period of time for the dipper to remain in the stall condition is selected. If the dipper stall time exceeds the selected value, then the speed at which the dipper handle 25 is removed from the bank is increased incrementally. An iterative process is then used with each subsequent time measurement until once again the selected ideal stall period is reached.

In a comparable fashion, the rate at which the hoist motor speed changes is also monitored. An ideal rate of change of the hoist motor speed is initially selected. If the rate of change in speed is then too low, the point at which the direction of movement of the dipper handle 25 is reversed becomes sooner than it was previously. This is accomplished by raising the low speed value incrementally. once again, an iterative process is then used with each subsequent stall condition, by adjusting the low speed value up or down until the desired rate of change in the hoist motor speed is achieved.

More particularly, the dipper handle moving means further includes means for varying the selected speed of movement of the dipper toward the boom. Still more particularly, the shovel 8 further includes means for determining the amount of time the hoist motor speed is below a predetermined low-speed value while under high torque, and means for adjusting the selected speed of movement of the dipper handle 25 toward the boom 15 upward if the time the hoist motor speed is below a predetermined low-speed value while under high torque is too large, and for adjusting the selected speed of movement of the dipper handle 25 toward the boom 15 downward if the time the hoist motor speed is below a predetermined low-speed value while under high torque is too small. The shovel 8 further includes means for determining the rate of change of the actual hoist motor speed while under high torque, and means for adjusting the low speed value upward if the rate of change of the actual hoist motor speed while under high torque is too fast, and for adjusting the low speed value downward if the rate of change of the actual hoist motor speed while under high torque is too slow. In the preferred embodiment of the invention, all of the above is accomplished by programming within the PLC.

What is claimed is:

1. A shovel including a dipper for gathering material from a bank, a platform, an upwardly extending boom connected at a lower end to the platform, a sheave rotatably amounted on the upper end of the boom, a winch drum mounted on the platform, a hoist motor for rotating the winch drum, a hoist rope extending from the winch drum over the sheave and attached to the dipper, a saddle block pivotally mounted on the boom, a dipper-handle slidably supported by the saddle block, and pivotable relative to the boom by the saddle block, dipper handle moving means for moving the dipper and dipper handle away from and towards the boom, said means including a crowd motor, and crowd motor operating means for operating the crowd motor, hoist motor operating means for operating the hoist motor, speed means for monitoring the hoist motor speed, torque means for monitoring the hoist motor torque, and means communicating with said crowd motor operating means, said torque means and said speed means for moving the dipper handle toward the boom when the hoist motor speed is below a low-speed value while under high torque, and for permitting movement of the dipper handle away from the boom when the hoist motor speed is above said low-speed value or not under high torque.

2. A shovel in accordance with claim 1, said dipper handle moving means further including means for varying the selected speed of movement of the dipper toward the boom.

3. A shovel in accordance with claim 2 and further including means for determining the amount of time the hoist motor speed is below a predetermined low-speed value while under high torque, and means for adjusting the selected speed of movement of the dipper handle toward the boom upward if the time the hoist motor speed is below a predetermined low-speed value while under high torque is too large, and for adjusting the selected speed of movement of the dipper handle toward the boom downward if the time the hoist motor speed is below a predetermined low-speed value while under high torque is too small.

4. A shovel in accordance with claim 1 and further including means for determining the rate of change of the actual hoist motor speed while under high torque, and means for adjusting the low speed value upward if the rate of change of the actual hoist motor speed while under high torque is too fast, and for adjusting the low speed value downward if the rate of change of the actual hoist motor speed while under high torque is too slow.

5. A shovel in accordance with claim 1, wherein said speed means is a voltage sensor.

6. A shovel in accordance with claim 1, wherein said torque means is a current sensor.

* * * * *